United States Patent [19]

Iguchi

[11] 4,147,094

[45] Apr. 3, 1979

[54] VACUUM OPERATED DEVICE

[75] Inventor: Masaru Iguchi, Katsuta, Japan

[73] Assignee: Hitachi, Ltd., Japan

[21] Appl. No.: 763,694

[22] Filed: Jan. 28, 1977

[30] Foreign Application Priority Data

Jan. 28, 1976 [JP] Japan ..... 51-7508

[51] Int. Cl.[2] ..... F01B 19/00

[52] U.S. Cl. ..... 92/48; 92/49; 92/94; 92/99

[58] Field of Search ..... 92/48, 49, 64, 65, 94, 92/97, 130 D, 99; 91/167 R

[56] References Cited

U.S. PATENT DOCUMENTS

| | | | |
|---|---|---|---|
| 2,667,150 | 1/1954 | Coar | 92/49 |
| 3,116,918 | 1/1964 | Francis | 92/49 |
| 3,375,838 | 4/1968 | Cheek | 92/48 |
| 3,613,513 | 10/1971 | Johnson | 92/48 |
| 3,618,473 | 11/1971 | Miller | 92/48 |
| 3,824,903 | 7/1974 | Hahn | 92/48 |

*Primary Examiner*—Martin P. Schwadron
*Assistant Examiner*—Abraham Hershkovitz
*Attorney, Agent, or Firm*—Craig & Antonelli

[57] ABSTRACT

A vacuum operated device is provided with a first vacuum chamber defined by a part of a casing and a first diaphragm; a second vacuum chamber defined by the first diaphragm, another part of the casing, and a second diaphragm; and a rod. The first vacuum chamber communicates with a vacuum source and the second vacuum chamber also communicates with the vacuum source through a changeover valve by which the second vacuum chamber is subjected to the vacuum from the vacuum source or to atmospheric pressure. The rod is secured to the first and second diaphragms at the central portions thereof thereby being axially movable according to the movement of the first and second diaphragms. The vacuum operated device further is provided with a first spring for subjecting the first diaphragm to a spring force opposite to the force that is exerted on the first diaphragm by the vacuum in the first vacuum chamber, and a second spring arranged functionally in series with the first spring for subjecting the rod to a force opposite to the force exerted on the rod by the first and second diaphragms, whereby the rod can be made to have two modes of movements thereby providing different kinds of spark advance characteristics.

5 Claims, 10 Drawing Figures

VACUUM OPERATED DEVICE

BACKGROUND OF THE INVENTION

This invention relates to a vacuum operated device, particularly to a vacuum operated device suitable to be used for ignition timing adjustment of an internal combustion engine as its exhaust gas purifying measures.

In a conventional internal engine, particularly in one for automobiles, during the time of low temperature if a throttle valve of a carburetor is opened by a little combustion of the fuel-air mixture is not effected enough, thereby increasing components of HC and CO in the exhaust gas. In order to decrease these components, it is necessary to advance ignition timing. On the other hand, during the time of low temperature if the throttle valve is opened large, knocking is brought about. In such a case, the ignition timing must not be advanced.

Thus, it is necessary to control the ignition timing also according to various throttle valve openings.

SUMMARY OF THE INVENTION

An object of the present invention is to provide a vacuum operated device which can effect different spark advance characteristics with a single device.

Another object of the present invention is to provide a vacuum operated device which can control ignition timing according to the throttle valve opening of a carburator so that its exhaust gas can be purified reasonably.

According to the present invention, the vacuum operated device comprises a casing, a first diaphragm disposed in the casing and defining in cooperation with the casing a first vacuum chamber which is always subjected to vacuum, a second diaphragm disposed in the casing and defining in cooperation with the first diaphragm a second vacuum chamber which is selectively subjected to the vacuum or to atmospheric pressure, a rod connected to the first and second diaphragms, a first spring for subjecting the first diaphragm to a force due to the spring, which force is opposite to the force of the first diaphragm due to the vacuum in the first vacuum chamber, and a second spring for applying a spring force to the rod, the spring force being opposite to the force of the rod due to pressure subjected to the first and second diaphragms and said first and second springs being applied in series with each other to the rod, whereby various kinds of axial movement of the rod can be achieved thereby providing different kinds of spark advances characteristics.

DESCRIPTION OF THE PREFERRED EMBODIMENTS

Referring to the accompanying drawings, an embodiment of the present invention will be described hereinafter in detail.

Figure 1:
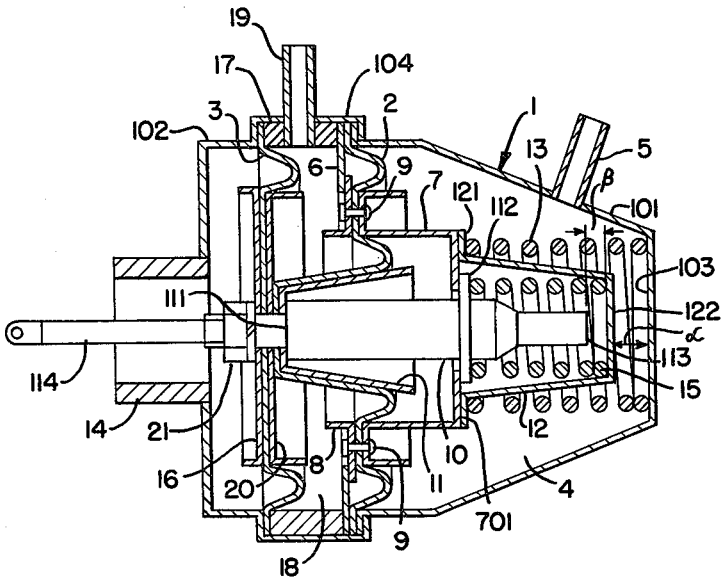
FIG. 1 is a sectional view of an embodiment of a vacuum operated device according to the present invention.

In FIG. 1, there is shown a vacuum operated device according to the present invention. A casing 1 which defines a casing of the vacuum operated device comprises first and second casing parts 101 and 102 which are assembled as described below. The casing 1 is provided with a first diaphragm 2 and a second diaphragm 3 in its interior. The first diaphragm 2 and part of the casing 1 define a first vacuum chamber 4 which has a first pipe 5 secured to the casing 1. The first diaphragm 2, the second diaphragm 3, a spacer 17, a diaphragm seat 6 and the first casing part 101 are inserted in an enlarged portion 104 of the second casing part 102 and air-tightly fixed to the casing 1 by bending the end of the enlarged portion 104. The first diaphragm 2 has a curved portion at its slightly inward portion, and at a further inward portion from the curved portion, a driving plate 7 and a stop plate 8 which are secured to the first diaphragm by rivets 9 in such a manner that the driving member 7 and the stop plate 8 are disposed in the first and second vacuum chambers 4, 18 respectively and sandwich the first diaphragm 2. The stop plate 8 engages with the diaphragm seat plate 6 at an inward extending portion to restrain a leftward deformation of the first diaphragm 2. The diaphragm 2 is hollowed (bowed) leftwardly at a central portion thereof. In the hollowed portion, a conical member 11 is fitted. The first diaphragm 2 and the conical member 11 have holes at their centers in which a rod 10 is inserted. The second diaphragm 3 is sandwiched by backing plates 16 and 20 in such a manner that a curved portion is formed in vinicity of its outer peripheral portion. The second diaphragm 3 and backing plates 16 and 20 have holes made at their centers, and the rod 10 also is inserted in these holes. The five members are sandwiched and fixed by a shoulder portion 111 made on the rod 10 and a nut 21.

The abovementioned driving member 7 has a cylindrical portion extending rightward along the rod 10 and a stopper portion 701 which is an inwardly turned portion of the driving member 7 that is engaged with an end of a spring receiving box 12 which is frusto-conically shaped. The spring receiving box 12 has an outwardly directed flange 121, and a flat portion 122. A first spring 13 is compressed and inserted between the flange 121 and a flat portion 103 of the casing 1 to press the spring receiving box 12 to the driving member 7, whereby the stop plate 8 fixed to the first diaphragm 2 engages with the diaphragm seat plate 6. In this condition a distance between the flat portion 122 of the spring receiving box 12 and the flat portion 103 of the casing 1 is kept $\alpha$.

The rod 10 has a flange 112 made for engagement with the stopper portion 701 of the driving member 7. Between the flange 112 and the flat portion 122 of the spring receiving box 12, a second spring 15 which is less in its spring force then the first spring 13 is compressed and inserted so that the flange 112 of the rod 10 contacts with the stopper portion 701 of the driving member 7. The flat portion 122 of the spring receiving box 12 and the end 113 of the rod 10 are kept a distance $\beta$. Thus the first spring 13 and the second spring 15 are arranged in series.

The first and second diaphragms 2, 3 are spaced by the spacer 17 to define the second vacuum chamber 18. The spacer 17 has a second pipe 19 communicating with the second vacuum chamber 18.

The vacuum operated device has a sleeve 14 secured to the second casing part 102, and the sleeve is used for connecting the vacuum operated device with the other device or machine. The opposite end 114 of the rod 10 to the end 113 is passed through the sleeve 14 and connected to an ignition timing control device.

Figure 2:
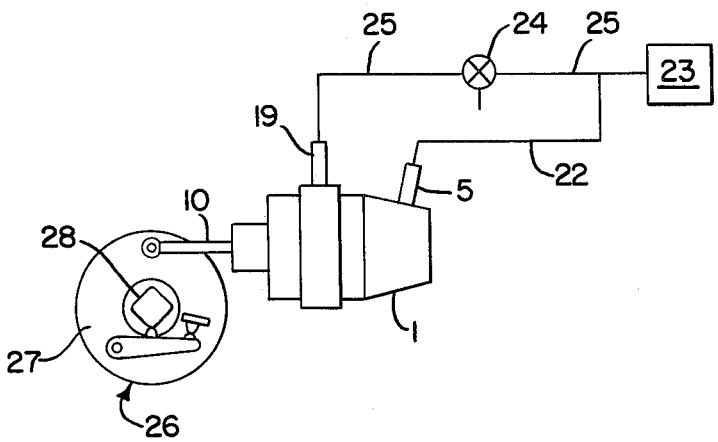
FIG. 2 is a schematic diagram of ignition timing control apparatus employing the vacuum operated device shown in FIG. 1.

In FIG. 2, the ignition timing control device employing the distributor 26 having the disc 27 with contacts thereon actuated by a rotary shaft 28, and the vacuum operated device according to the present invention is shown, the first pipe 5 is connected with vacuum source 23 by a tube 22, whereby the first vacuum chamber 4 communicates with the vacuum source 23. The second pipe 19 is connected with the vacuum source 23 by a tube 25 with a changeover valve 24, whereby the second vacuum chamber 18 communicates with atmosphere or the vacuum source 23 according to operation of the changeover valve 24.

Next operation of the above constructed vacuum operated device will be described.

Figure 3:
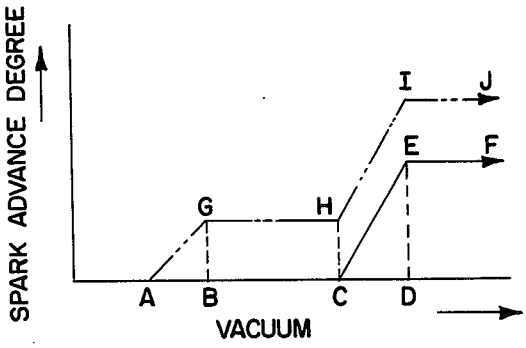
FIG. 3 is a diagram showing an example of a spark advance characteristic which can be effected by employing the system shown in FIG. 2.

When the second vacuum chamber 18 communicates with atmosphere by the operation of the changeover valve 24, the second vacuum chamber is at a atmospheric pressure, and vacuum from the vacuum source 23 is introduced only into the first vacuum chamber 4. By the vacuum, a rightward force is exerted on the first diaphragm 2 to compress the first spring 13. But, when the vacuum is small, the force exerted on the first diaphragm can not overcome the first spring 13, so that the first diaphragm 2 is not deformed. When the vacuum increases, that is beyond C as shown in FIG. 3, the rightward force on the first diaphragm 2 can overcome the spring force of the first spring 13, so that the first diaphragm 2 is deformed to move rightward. In this case, the driving member 7 makes a rightward movement of the rod 10 by the flange 112 to change ignition timing of the ignition timing control device 26 connected to the end 114 thereof. When the vacuum increases to D as shown in FIG. 3, a amount of the rightward movement of the first diaphragm 2 is $\alpha$ as shown in FIG. 1, whereby the flat portion 122 made at the front portion of the spring receiving box 12 contacts with the flat portion 103 of the casing 1. Further, even if the vacuum increases beyond D, the first diaphragm 2 does not move rightwards, since the spring receiving box 12 is contacting with the casing 1. Thus, when the second vacuum chamber 18 is open to the atmosphere through the changeover valve 24, characteristic of spark advance such as C, E, F of FIG. 3 can be effected. In this case, the rod 10 moves along with the driving member 7 and the spring receiving box 12 since the flange 112 of the rod 10 is contacted with the stopper portion 701 of the driving member 7 by a leftward force extered with an atmospheric pressure applying to the second diaphragm 3. Therefore, the characterictic of spark advance of C, E, F is effected not by the second spring 15, but only by the first spring 13.

When the second vacuum chamber 18 communicates with the vacuum source 23 through operation of the changeover valve 24, the first vacuum chamber 4 and the second vacuum chamber 18 are kept at the same pressure, so that force due to the vacuum, that is an atmospheric pressure is subjected only to the second diaphragm 3. When the vacuum increases beyond A of FIG. 3, a force exerted on the second diaphragm 3 overcomes a spring force of the second spring 15 to compress the second spring 15 thereby making a rightward movement of the rod 10. When the vacuum reaches to B of FIG. 3, displacement of the second diaphragm 3 reaches to B, and the end 113 of the rod 10 contacts with the flat portion 103 of the casing 1, whereby the second diaphragm 3 and the rod 10 is prevented from further rightward moving by spring force of the first spring 13 (GH of FIG. 3). When the vacuum increases beyond C, force applied to the second diaphragm 3 overcomes a force of the first spring 13 to further move rightwards, and at a vacuum D, the spring receiving box 12 contacts with the flat portion 103 of the casing 1 whereby the movement of the second diaphragm 3 comes to an end. Thus the maximum displacement of the second diaphragm 3 that is the maximum displacement of the rod 10 is $\alpha + \beta$, whereby a characteristic of spark advance of AGHIJ as shown in FIG. 3 is obtained.

According to the above embodiment of the present invention, by the operation of the changeover valve 24 that the second vacuum chamber 18 is made to a condition subject to an atmospheric pressure or to the same pressure as the first vacuum chamber 4, two kinds of characteristics such as CEF and AGHIJ can be obtained.

Figure 4:
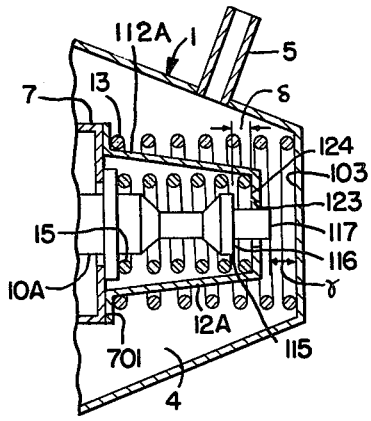
FIG. 4 is a section view of another embodiment of a vacuum operated device according to the present invention.

A second embodiment of the present invention will be described referring to FIG. 4 which shows different portions from the first embodiment. In this embodiment, a spring receiving box 12A has a hole 123 made at a portion opposite to the flat portion 103 of the casing 1, and in the hole 123 the right end 117 of a rod 10A is inserted to project rightwards from the flat portion 124 of the spring receiving box 12A by a small portion thereof so that the right end 117 is spaced by $\gamma$ from the flat portion of the casing 1. The rod 10A has another flange 115 in addition to a flange 112A corresponding to the flange 112 in the first embodiment. The flange 115 serves as a stopper and the stop face 116 is spaced by $\delta$ from the flat portion 124 of the spring receiving box 12A.

Figure 5:
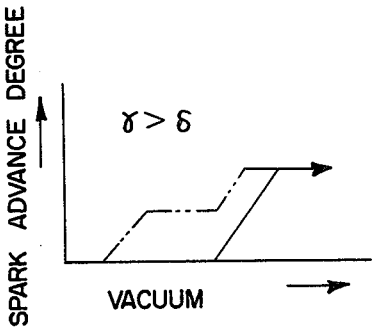
FIGS. 5 and 6 are diagrams each showing an example of a spark advance characteristic effected by using the device shown in FIG. 4.
Figure 6:
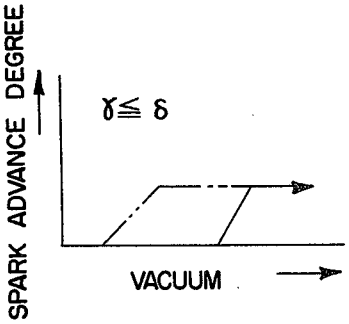

According to the second embodiment of the present invention, the maximum displacement of the rod 10A is $\delta$ whether the second vacuum chamber 18 is subjected to an atmospheric pressure or a vacuum, and a spark advance characteristic as shown in FIG. 5 or FIG. 6 is obtained according to a relation of scale between $\gamma$ and $\delta$. In FIG. 5 showing the case of $\gamma > \delta$, in case that only the first vacuum chamber 4 is subjected to vacuum, the maximum displacement of $\gamma$ is obtained as shown by a solid line, next, when the second vacuum chamber 18 also is subjected to vacuum, the displacement becomes constant after once a displacement of $\delta$ is obtained, and then the maximum displacement of $\gamma$ is obtained. In case of $\gamma \leqq \delta$, shown in FIG. 6, when only the first vacuum chamber 4 is subjected to vacuum, a characteristic as shown by a solid line in FIG. 6 that is the maximum displacement of $\gamma$ is obtained.

Figure 7:
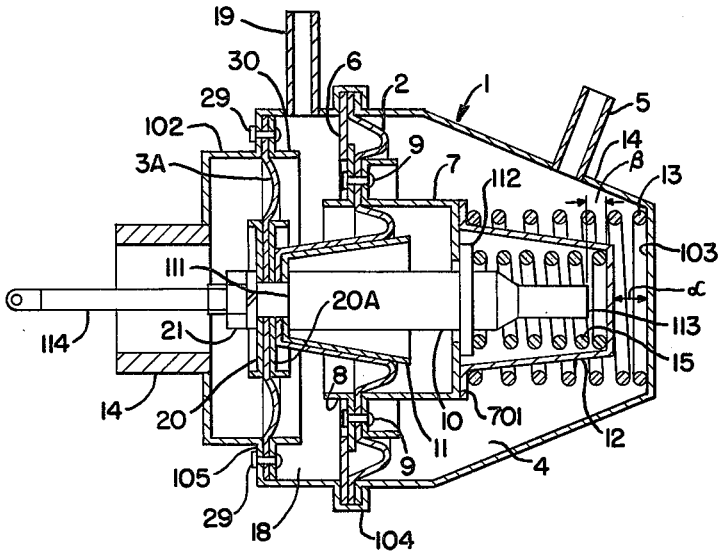
FIG. 7 is a section view of still another embodiment of a vacuum operated device according to the present invention.
Figure 8:
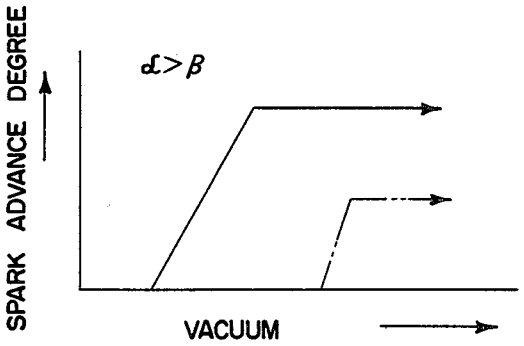
FIGS. 8, 9 and 10 each are a diagrams showing an example of a spark advance characteristic obtained by using the device shown in FIG. 7.
Figure 9:
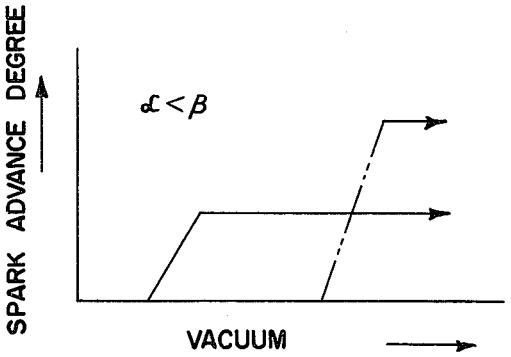
Figure 10:
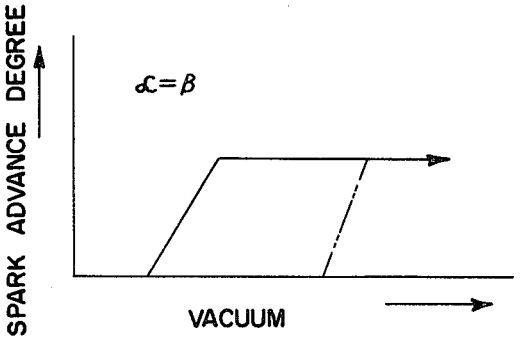

A third embodiment of the present invention will be described, referring to FIG. 7. The embodiment differs from the first embodiment in that an area of pressure receiving face of a second diaphragm 3A is smaller than that of the second diaphragm 3 in the first embodiment. That is a casing part 102A has a sholder portion 105 made. A second diaphragm 3A is fixed to the inside of the sholder portion 105 by a diaphragm holder 30 and rivets so that the area of pressure receiving portion of the second diaphragm 3A is reduced by an area held by the sholder portion 105. According to the third embodiment of the present invention, characteristics of FIGS. 8, 9 and 10 are obtained in accordance with a relative scale of distance $\alpha$ and $\beta$. The second diaphragm 3A has a smaller receiving area than that of the first diaphragm 2 so that by a force induced to the second diaphragm 3A by a vacuum usually applied to the second vacuum chamber 18 the spring force of the first spring 13 is not overcome. Therefore, in case of $\alpha > \beta$ as shown in FIG. 8, when only the first vacuum chamber 4 is subjected to vacuum, displacement of $\alpha$ as shown by a solid line is obtained, when the second vacuum chamber 18 also is subjected to vacuum, the second disphragm 3A overcomes the second spring 15 to move rightwards by $\beta$ so that a spark advance characteristic shown by a broken line is obtained. When a vacuum is subjected to both the first and second vacuum chambers 4 and 18 the first spring 13 is compressed by the second diaphragm 3A, but the second diaphragm 3A is little in its pressure receiving area so that movement of the rod 10 by $\alpha$ can not be obtained. In FIGS. 9 and 10, spark advance characteristics in cases of $\alpha < \beta$ and $\alpha = 10$ are shown respectively, the advance characteristic shown by a solid line is effected by subjecting the first vacuum chamber to vacuum and the second chamber to atmospheric pressure, and the spark advance characteristic shown by a broken line is obtained by subjecting only the first vacuum chamber to vacuum.

As apparent from the above, according to the present invention, two different kinds of spark advance characteristic can be obtained. For example by incorporating the vacuum operated device to the ignition timing control apparatus in the time of low temperature of the engine, when the throttle valve of the carburetor opening is small, ignition timing can be advanced by introducing vacuum into the second vacuum chamber whereby conbustion becomes enough so that production of HC and CO is eliminated. In case of large opening of the throttle valve, an amount of spark advance is made small by subjecting the second vacuum chamber to atmospheric pressure, so that knocking can be prevented. Accordingly at the time of low temperature exhaust gas can be purified reasonably.

What is claimed is:

1. A vacuum operated device comprising a casing, a first diaphragm disposed in and at its periphery secured to the casing and defining these with a first vacuum chamber which has a pipe communicating with a vacuum source, a second diaphragm disposed in the casing with a spaced distance between the first and second diaphragms, its periphery fixed to the casing and defining a second vacuum chamber between itself and the first diaphragm which has a pipe communicated with the vacuum source through a changeover valve, a rod communicated with the vacuum source through a changeover valve, a rod connected to both centers of the first and second diaphragms, said rod being connected to an output means extending outside said casing, a driving member disposed in the first vacuum chamber and connected to the first diaphragm between the center and the periphery thereof, said driving member for causing movement of the rod, a spring receiving box contacting the driving member, a first spring disposed between the casing and the spring receiving box and pressing the spring receiving box into contact with the driving member, a second spring contained in the spring receiving box and pressing a flange of the rod into engagement with the driving member, and a stopper disposed in and connected to the casing for restraining movement of the first diaphragm by the first spring acting on the spring receiving box and the driving member.

2. The vacuum operated device according to claim 1, wherein the rod has another flange disposed in the spring receiving box for engagement with the spring receiving box, and the spring receiving box has a hole allowing the end of the rod to pass therethrough.

3. A vacuum operated device comprising:

a casing axially extending and having a closed end portion;

a first diaphragm secured to the casing at its periphery and defining therewith a first vacuum chamber;

a second diaphragm secured to the casing at its periphery and defining a second vacuum chamber in cooperation with the casing and the first diaphragm, the second vacuum chamber selectively communicating with a vacuum source;

a rod connected to an output means extending outside the casing, said rod extending axially of the casing, secured to both the first and second diaphragms, and having an end projecting into the first vacuum chamber, the rod having an engagement portion between a portion secured to the first diaphragm and the end in the first vacuum chamber;

a seat member secured to the casing and disposed in the second vacuum chamber for restraining movement of the first diaphragm;

a stopper means secured to a radially intermediate portion of the first diaphragm for contacting said seat member;

a driving member secured to the radially intermediate portion of the first diaphragm and disposed in the first vacuum chamber for causing movement of the rod;

a spring receiving member having a portion contacting with the driving member and an end portion extending axially of the rod and facing the closed end portion of the casing;

a first spring disposed between and compressed by the closed end of the casing and the contacting portion of the spring receiving member so that the stopper means contacts with the seat member when vacuum is not applied to the first vacuum chamber; and a second spring disposed between and compressed by the engagement portion of the rod and the end portion of the spring receiving member so that the engagement portion of the rod contacts with the driving member when vacuum is not applied to the second vacuum chamber.

4. The vacuum operated device according to claim 3, wherein the end of the rod in the first vacuum chamber is axially spaced by a predetermined distance from the end portion of the spring receiving member so that the axial movement of the rod is restrained by the spring receiving member when the rod moves axially by the predetermined distance.

5. The vacuum operated device according to claim 3, wherein the pressure receiving area of the second diaphragm is less than that of the first diaphragm.

* * * * *